US005308517A

United States Patent [19]

Habeeb et al.

[11] Patent Number: 5,308,517

[45] Date of Patent: May 3, 1994

[54] ASHLESS LUBE ADDITIVES CONTAINING COMPLEXES OF ALKOXYLATED AMINES, DIHYDROCARBYLDITHIOPHOSPHORIC ACID, AND ADENINE

[75] Inventors: Jacob J. Habeeb; Morton Beltzer, both of Westfield, N.J.

[73] Assignee: Exxon Research & Engineering Co., Florham Park, N.J.

[21] Appl. No.: 21,296

[22] Filed: Feb. 22, 1993

[51] Int. Cl.[5] ..... C10M 105/72

[52] U.S. Cl. ..... 252/32.7 R; 252/32.7 E; 558/207; 544/277

[58] Field of Search ..... 252/32.7 R, 32.7 E; 558/207; 544/277

[56] References Cited

U.S. PATENT DOCUMENTS

| | | | |
|---|---|---|---|
| 2,618,608 | 11/1952 | Schaeffer | 252/524 |
| 3,361,668 | 1/1968 | Wiese | 252/32.7 |
| 3,997,454 | 12/1976 | Adams | 252/18 |
| 4,089,790 | 5/1978 | Adams | 252/18 |
| 4,132,657 | 1/1979 | Verdicchio et al. | 252/32.5 |
| 4,163,729 | 8/1979 | Adams | 252/18 |
| 4,244,827 | 1/1981 | Michaelis et al. | 252/46.4 |
| 4,501,677 | 2/1985 | Habeeb | 252/37.2 |
| 4,557,845 | 12/1985 | Horodysky et al. | 252/49.9 |
| 4,721,802 | 1/1988 | Forsberg | 558/207 |
| 4,774,351 | 9/1988 | Forsberg | 558/207 |
| 4,917,809 | 4/1990 | Zinke et al. | 252/32.7 E |
| 4,965,002 | 10/1990 | Brannen et al. | 252/32.5 |
| 5,080,813 | 1/1992 | Kammann et al. | 252/32.7 R |

*Primary Examiner*—Jacqueline V. Howard
*Assistant Examiner*—Cephia D. Toomer
*Attorney, Agent, or Firm*—James H. Takemoto

[57] ABSTRACT

A composition of matter having utility in lubricant formulations, said composition being the reaction product of adenine, alkoxylated amine and dihydrocarbyldithiophosphoric acid and having the general formula (I):

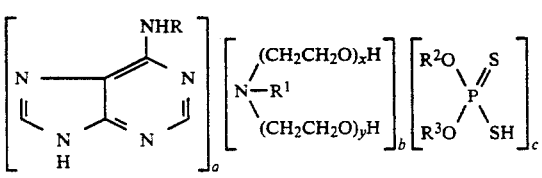

(I)

where R is hydrogen or a hydrocarbyl group of from 1 to 20 carbon atoms, $R^1$ is a hydrocarbyl group of 2 to 22 carbon atoms, $R^2$ and $R^3$ are each independently hydrocarbyl groups having from 3 to 30 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

10 Claims, No Drawings

ASHLESS LUBE ADDITIVES CONTAINING COMPLEXES OF ALKOXYLATED AMINES, DIHYDROCARBYLDITHIOPHOSPHORIC ACID, AND ADENINE

BACKGROUND OF THE INVENTION

1. Field of the Invention

This invention relates to the reaction product of adenine, alkoxylated amine and dihydrocarbyldithiophosphoric acid and to an improved lubricating oil composition containing the reaction product which shows excellent antiwear and copper corrosion inhibition properties.

2. Description of the Related Art

In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). For example, U.S. Pat. No. 4,575,431 discloses a lubricating oil additive composition containing dihydrocarbyl hydrogen dithiophosphates and a sulfur-free of hydrocarbyl dihydrogen phosphates and dihydrocarbyl hydrogen phosphates, said composition being at least 50% neutralized by a hydrocarbyl amine having 10 to 30 carbons in said hydrocarbyl group. U.S. Pat. No. 4,089,790 discloses an extreme-pressure lubricating oil containing (1) hydrated potassium borate, (2) an antiwear agent selected from (a) ZDDP, (b) an ester, an amide or an amine salt of a dihydrocarbyl dithiophosphoric acid or (c) a zinc alkyl aryl sulfonate and (3) an oil-soluble organic sulfur compound.

Oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns. However, many ashless additive packages tend to be corrosive to copper which leads to additional components in the additive package.

It would be desirable to have a lubricating oil additive which provides excellent antiwear, antioxidation, fuel economy and environmentally beneficial (less fuel, i.e., less exhaust emissions) properties while at the same time protecting the engine from copper corrosion.

SUMMARY OF THE INVENTION

The present invention relates to a novel composition of matter containing adenine, alkoxylated amine and dihydrocarbyldithiophosphoric acid and to an improved lubricating oil composition which, in addition to providing antiwear and fuel economy properties, also provides copper corrosion and antioxidancy properties. The composition of matter has the general formula (I) and is a complex comprising the reaction product of adenine, alkoxylated amine and dihydrocarbyldithiophosphoric acid, said complex having the formula

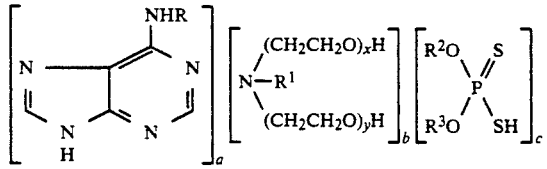

(I)

where R is hydrogen or a hydrocarbyl group of from 1 to 20 carbon atoms, $R^1$ is a hydrocarbyl group of 2 to 22 carbon atoms, $R^2$ and $R^3$ are each independently hydrocarbyl groups having from 3 to 30 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

The present invention is also directed to a lubricant composition comprising (a) a major amount of a lubricating oil basestock and (b) a minor amount of a complex having the general formula (I) and a method for reducing wear and inhibiting copper corrosion in an internal combustion engine which comprises operating the engine with lubricating oil composition containing an effective amount to reduce wear of a complex of the formula (I).

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen)

without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

In the oil soluble complexes of the present invention having the general formula I, R is preferably hydrogen or a hydrocarbyl group of from 1 to 16 carbon atoms, most preferably hydrogen, $R^1$ is preferably a hydrocarbyl group of from 2 to 18 carbon atoms, especially 6 to 18 carbon atoms. $R^2$ and $R^3$ are preferably hydrocarbyl groups having from 3 to 15 carbon atoms. Such hydrocarbyl groups include aliphatic (alkyl or alkenyl) and alicyclic groups. The aliphatic and alicyclic groups may be substituted with hydroxy, amino, mercapto and the like and the aliphatic or alicyclic groups may be interrupted by 0, S or N. The sum of $x+y$ is preferably 2 to 15.

The complexes are the reaction product of an alkoxylated, preferably propoxylated or ethoxylated, especially ethoxylated amine of the formula

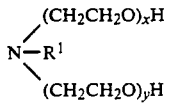

(a)

where $R^1$, x and y are defined as described above, a dihydrocarbyldithiophosphoric acid of the formula

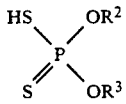

(b)

where $R^2$ and $R^3$ are defined as described above, and adenine which has the formula

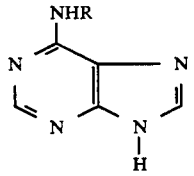

(c)

where R is defined as above.

Alkoxylated amines of the formula (a), dihydrocarbyldithiophosphoric acids of the formula (b) and adenine (c) are all commercially available compounds or may be prepared by methods known in the art. For example, ethoxylated amines are manufactured by Sherex Chemicals under the trade name Varonic ® and by Akzo Corporation under the trade name(s) Ethomeen ® and Ethoduomeen ®. Dihydrocarbyldithiophosphoric acids and adenine may be purchased from Exxon Chemical Company and Aldrich Chemical Company. Especially preferred (a) are ethoxylated (5) cocoalkylamine, ethoxylated (2) tallowalkylamine and especially preferred (b) are dialkyldithiophosphoric acid made from mixed (85%) 2-butyl alcohol and (15%) isooctyl alcohol (mixed primary and secondary alcohols). Propoxylated amines may be substituted for ethoxylated amines.

The complexes having the general formula (I) are prepared as described below. This preparation is based on an approximate 1:1:1 mole ratio although this ratio may vary. About 10 to 20% of the required amount of alkoxylated amine (based on phosphoric acid) is added to dihydrocarbyldithiophosphoric acid with heating and stirring. Temperatures may range from about 25°to about 180° C. About 10 to 20% of the required amount of adenine is then added. This sequential addition process is repeated until the required stoichiometric amounts (1:1:1 of amine:acid:adenine) is reached. A precipitate (polymeric and unidentified material) forms if this sequential addition procedure is not employed.

The precise stoichiometry of the bonding in the complexes of the formula (I) is not known since each molecule in the complex may have several sites which can take part in the hydrogen bonding process either as an acceptor or donor. Because of the multiplicity of bonding possibilities, the molar ratios a:b:c can be varied over a wide range based on the donor/acceptor sites on each of the three molecules and therefore a, b and c in formula (I) are numbers which are not necessarily integral. There exist a total of fifteen combinations of interaction sites between the three molecules comprising the complex of the formula (I). For example, a:b:c may be 1:2:1 or 1:1:3 which are just two of the fifteen possible combinations.

The present lubricating oil composition contains a major amount of lubricating oil basestock and an effective amount necessary to impart antiwear, antioxidation, fuel economy and anticorrosion properties to the oil. The concentration of complex of the general formula (I) may typically range from about 0.1 to about 5 wt. %, based on oil, preferably about 0.5 to about 1.5 wt. %.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, friction modifiers, and the like. These additives are typically disclosed, for example in "Lubricant Additives" by C. V. Smalhear and R. Kennedy Smith, 1967, pp. 1-11 and in U.S. Pat. No. 4,105,571, the disclosures of which are incorporated herein by reference.

The lubricating oil composition of the invention is further illustrated by the following examples which also illustrate a preferred embodiment.

EXAMPLE 1

This example illustrates the preparation of the novel complex of the invention. A solution of 80 g of diisooctyldithiophosphoric acid was heated to 50°-110° C. with stirring. 10 g of ethoxylated (5) cocoalkylamine was then added to the heated and stirred solution followed by 1 g of adenine. This procedure of sequentially adding ethoxylated amine and adenine was repeated until 75 g of ethoxylated (5) cocoalkylamine and 7 g of adenine have been added to the solution. The sequential addition procedure was employed to prevent precipitation of byproduct. The complex was then collected on cooling and used without further purification.

EXAMPLE 2

This example illustrates the superior copper corrosion provided by the complex of the invention. Amine salts were prepared as described in Example 2 and the complex prepared as described in Example 1. The test for copper corrosion were run as follows. Copper corrosion tests were based on ASTM D-2440. 25 g of oil sample is placed in a 0.5" test tube with 30 cm of copper wire coiled to 0.5" and stretched to a finished length of 2". The test tube is then heated at 110° C. for 120 hours. Nitrogen is bubbled through the oil at 17 cc/min during the test period. A 5 g sample of oil is removed at the end of the test and analyzed for copper content. Results of the copper corrosion are shown in Table 1.

TABLE 1

| | | Copper Corrosion (ppm) |
|---|---|---|
| Base case - | Lubricating oil | 21 |
| Base case +1% | Ethoxylated(5)cocoamine: DDP (diisooctyl) | 37 |
| Base case +1% | Ethoxylated(5)cocoamine: DDP (diisooctyl):Adenine | 17 |
| Base case +1.5% | Ethoxylated(5)cocoamine: DDP (diisooctyl) | 57 |
| Base case +1.5% | Ethoxylated(5)cocoamine: DDP (diisooctyl):Adenine | 23 |
| Base case +1% | Ethoxylated(2)tallowamine: DDP (secondary)* | 74 |
| Base case +1% | Ethoxylated(2)tallowamine: DDP (secondary):Adenine | 18 |
| Base case +1.5% | Ethoxylated(2)tallowamine: DDP (secondary) | 107 |
| Base case +1.5% | Ethoxylated(2)tallowamine: DDP (secondary):Adenine | 23 |

*DDP (secondary) contains a mixture of isobutyl (85%) and isooctyl (15%) as the alkyl component.

EXAMPLE 3

This example illustrates the superior antiwear properties of the complex of the invention. Antiwear properties are measured by the four-ball wear test as follows. The Four Ball test used is described in detail in ASTM method D-2266, the disclosure of which is incorporated herein by reference. In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 mm. Prior to the tests, the test cup, steel balls, and all holders were washed with 1,1,1 trichloroethane. The steel balls subsequently were washed with a laboratory detergent to remove any solvent residue, rinsed with water, and dried under nitrogen.

The Four Ball wear tests were performed at 100° C., 60 kg load, and 1200 rpm for 45 minutes duration. After each test, the balls were washed and the Wear Scar Diameter (WSD) on the lower balls measured using an optical microscope. Using the WSD'S, the wear volume (WV) was calculated from standard equations (see Wear Control Handbook, edited by M. B. Peterson and W. O. Winer, p. 451, American Society of Mechanical Engineers [1980]). The percent wear reduction (% WR) for each oil tested was then calculated using the following formula:

$$\% WR = \left[ 1 - \frac{WV \text{ with additive}}{WV \text{ w/o additive}} \right] \times 100$$

The result of the four-ball are set forth in Table 2.

TABLE 2

| | Wear Scar Diameter (mm) | |
|---|---|---|
| % Additive in Solvent 150N* | Ethoxylated(5)-cocoamine: DDP(isooctyl) % wear volume reduction | Ethoxylated(5)-cocoamine: DDP(isooctyl):Adenine % wear volume reduction |
| 0 | 0.0 | 0.0 |
| 0.1 | −7.3 | 15.5 |
| 0.2 | 45.5 | 88.1 |
| 0.4 | 41.1 | — |
| 0.5 | — | 96.4 |
| 0.6 | — | 97.8 |
| 0.8 | 15.1 | 99.2 |
| 1.0 | −7.3 | 99.5 |
| 1.5 | 96.1 | 99.5 |

*S150 is a solvent extracted, dewaxed, hydrofined neutral lube base stock obtained from approved paraffinic crudes (viscosity, 32 cSt at 40° C., 150 Saybolt seconds)

The data in Table 2 demonstrate that even at low concentrations (<0.2%), the present adenine complex has superior antiwear properties over the corresponding amine salt without adenine.

What is claimed is:

1. A composition of matter comprising a complex which is the reaction product of adenine, alkoxylated amine and dihydrocarbyldithiophosphoric acid, said complex having the formula

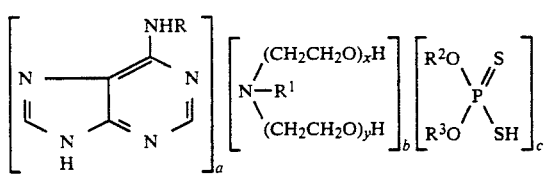

(I)

where R is hydrogen or a hydrocarbyl group of from 1 to 20 carbon atoms, R' is a hydrocarbyl group of 2 to 22 carbon atoms, $R^2$ and $R^3$ are each independently hydrocarbyl groups having from 3 to 30 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

2. The composition of claim 1 wherein $R^1$, is alkyl or alkenyl of 2 to 18 carbon atoms.

3. The composition of claim 1 wherein the sum of x+y is from 2 to 15.

4. The composition of claim 1 wherein R is hydrogen.

5. A lubricating oil composition comprising (a) a major amount of a lubricating oil basestock, and (b) a minor amount of a complex comprising the reaction product of adenine, alkoxylated amine and dihydrocarbyldithiophosphoric acid, said complex having the formula

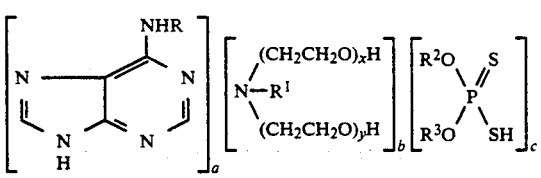

(I)

where R is hydrogen or a hydrocarbyl group of from 1 to 20 carbon atoms, $R^1$ is a hydrocarbyl group of 2 to 22 carbon atoms, $R^2$ and $R^3$ are each independently hydrocarbyl groups having from 3 to 30 carbon atoms, x and y are each independently integers of from 1 to 15 with the proviso that the sum of x+y is from 2 to 20, and a, b and c are independent numbers from 1.0 to 3.0 wherein the ratios between a:b, a:c and b:c range from 1.0:3.0 to 3.0:1.0.

6. The lubricant composition of claim 5 wherein $R^1$ is alkyl or alkenyl of 2 to 18 carbon atoms.

7. The lubricant composition of claim 5 wherein the sum of x+y is from 2 to 15.

8. The lubricant composition of claim 5 wherein R is hydrogen.

9. The lubricant composition of claim 5 wherein the concentration of the complex is from 0.1 to about 5 wt. %.

10. A method for reducing wear and inhibit copper corrosion in an internal combustion engine which comprises operating the engine with a lubricating oil composition containing an effective amount to reduce a wear of a complex of claim 5.

* * * * *